US005806595A

United States Patent [19]

Langford et al.

[11] Patent Number: 5,806,595

[45] Date of Patent: Sep. 15, 1998

[54] WELLBORE MILLING SYSTEM AND METHOD

[75] Inventors: Dale E. Langford, Lafayette, La.; Robert E. Robertson, Bakersfield, Calif.; Charles W. Pleasants, Cypress, Tex.; Thurman B. Carter, Pearland, Tex.; Guy L. McClung, III, Spring, Tex.

[73] Assignee: Weatherford/Lamb, Inc., Houston, Tex.

[21] Appl. No.: 642,118

[22] Filed: May 2, 1996

Related U.S. Application Data

[63] Continuation-in-part of Ser. No. 590,747, Jan. 24, 1996, which is a continuation-in-part of Ser. No. 414,201, Mar. 31, 1995, Pat. No. 5,531,271, which is a continuation-in-part of Ser. No. 300,917, Sep. 6, 1994, Pat. No. 5,425,417, which is a continuation-in-part of Ser. No. 225,384, Apr. 4, 1994, Pat. No. 5,409,060, which is a continuation-in-part of Ser. No. 119,813, Sep. 10, 1993, Pat. No. 5,452,759, which is a continuation-in-part of Ser. No. 210,697, Mar. 18, 1994, Pat. No. 5,429,187.

[51] Int. Cl.[6] ..... E21B 43/11

[52] U.S. Cl. ..... 166/298; 166/55.7

[58] Field of Search ..... 175/406; 166/55.6, 166/55.7, 55.8, 298

[56] References Cited

U.S. PATENT DOCUMENTS

| | | | |
|---|---|---|---|
| 1,454,048 | 5/1923 | Esperson | 166/298 |
| 1,902,174 | 3/1933 | Lewis | 175/406 |
| 1,937,742 | 12/1933 | Brink | 175/406 |
| 2,014,805 | 9/1935 | Hinderliter . | |
| 2,103,622 | 12/1937 | Kinzbach . | |
| 2,362,529 | 11/1944 | Barrett et al. . | |
| 2,685,431 | 8/1954 | James . | |
| 3,147,536 | 9/1964 | Lamphere | 175/406 |
| 4,266,621 | 5/1981 | Brock | 175/329 |
| 4,699,224 | 10/1987 | Burton | 175/61 |
| 4,717,290 | 1/1988 | Reynolds et al. | 407/34 |
| 4,796,709 | 1/1989 | Lynde et al. | 166/55.6 |
| 4,887,668 | 12/1989 | Lynde et al. | 166/55.8 |
| 4,938,291 | 7/1990 | Lynde et al. | 166/55.8 |
| 4,978,260 | 12/1990 | Lynde et al. | 166/55.6 |
| 4,984,488 | 1/1991 | Lunde et al. | 166/55.6 |
| 5,010,955 | 4/1991 | Springer | 166/298 |
| 5,014,778 | 5/1991 | Lynde et al. | 166/55.6 |
| 5,038,859 | 8/1991 | Lynde et al. | 166/55.6 |
| 5,058,666 | 10/1991 | Lynde et al. | 166/55.6 |
| 5,074,356 | 12/1991 | Neff | 166/55.7 |
| 5,086,838 | 2/1992 | Cassel et al. | 166/55.6 |
| 5,150,755 | 9/1992 | Cassel et al. | 166/297 |
| 5,181,564 | 1/1993 | Lindley et al. | 166/55.6 |
| 5,199,513 | 4/1993 | Stewart et al. | 175/73 |
| 5,253,710 | 10/1993 | Carter et al. | 166/298 |
| 5,297,630 | 3/1994 | Lynde et al. | 166/297 |
| 5,341,873 | 8/1994 | Carter | 166/117.5 |
| 5,373,900 | 12/1994 | Lynde et al. | 166/297 |
| 5,390,750 | 2/1995 | Deken et al. | 175/406 |
| 5,409,060 | 4/1995 | Carter | 166/237 |
| 5,425,417 | 6/1995 | Carter | 166/117.6 |
| 5,429,187 | 7/1995 | Beagrie et al. | 166/55.1 |
| 5,452,759 | 9/1995 | Carter et al. | 166/117.6 |
| 5,456,312 | 10/1995 | Lynde et al. | 166/55.6 |
| 5,522,461 | 6/1996 | Carter et al. | 166/298 |
| 5,551,509 | 9/1996 | Braddick | 166/55.7 |

OTHER PUBLICATIONS

"Catalog 1958–59," Kinzbach Tool Co., Inc., pp. 6, 7, 8; 1958.

"General Catalog 68–69," A–1 Bit & Tool Co., p. 136.

"Who Has Mills That Are Diamond Tough," Homco, 1974.

*Primary Examiner*—Hoang C. Dang

*Attorney, Agent, or Firm*—Guy McClung

[57] ABSTRACT

A method for milling an opening, slot, hole, or window in a tubular of a tubular string in a wellbore, has been invented which includes installing a mill system in the tubular at a desired milling location, and milling an opening in the tubular. In one aspect the method includes using a mill which has a weight member below the mill, above the mill, or both. In one aspect additional weight is added to the weight member once it has been introduced into the tubular string.

16 Claims, 7 Drawing Sheets

2B
2B
5
7
9
10
8
2
3
1
6

7
10
7
5

S
R
L
N
V

P
C
D
M
T

WELLBORE MILLING SYSTEM AND METHOD

RELATED APPLICATIONS

This is a continuation-in-part of a U.S. application Ser. No. 08/590,747 filed on Jan. 24, 1996 entitled "Wellbore Milling Guide" which is a continuation-in-part of U.S. application Ser. No. 08/414,201, filed on Mar. 31, 1995 entitled "Whipstock Side Support" (U.S. Pat. No. 5,531,271 issued on Jul. 2, 1996); which is a continuation-in-part of U.S. application Ser. No. 08/300,917, (U.S. Pat. No. 5,425,417 issued Jun. 20, 1995) filed on Sep. 6, 1994 entitled "Wellbore Tool Setting System," which is a continuation-in-part of U.S. application Ser. No. 08/225,384 (U.S. Pat. No. 5,409,060 issued Apr. 25, 1995), filed on Apr. 4, 1994 entitled "Wellbore Tool Orientation," which is a continuation-in-part of U.S. application Ser. No. 08/119,813 (U.S. Pat. No. 5,452,759 issued Sep. 26, 1995), filed on Sep. 10, 1993 entitled "Whipstock System"; and this is a continuation-in-part of U.S. application Ser. No. 08/210,697 (U.S. Pat. No. 5,429,187 issued Jul. 4, 1995), filed on Mar. 18, 1994 entitled "Milling Tool & Operations". This parent application and all parent applications of it are incorporated fully herein for all purposes.

BACKGROUND OF THE INVENTION

1. Field of the Invention

This invention is directed to milling tubulars in a wellbore and, in one aspect, to methods for directing a mill in a wellbore and apparatus useful in such methods.

2. Description of Related Art

An opening, slot, or a window is formed in a tubular, e.g. casing, in a wellbore with a milling tool with one or more mills. Typically the tool is threadably attached to a section of drill pipe or other heavy tubular components comprising a bottom hole assembly that is in a well to cut a window through the side of a piece of casing. In certain methods the milling tool is assisted in generating a window by a device known as a whipstock, a wedge shaped object, anchored in the casing wellbore which serves to support the milling tool and forcibly direct it outward through the side of the casing, the facilitating formation of the window.

In certain methods a whipstock is not utilized, and the ability of the milling tool to generate the window without the wedge shape forcing it through the casing is severely inhibited and often practically impossible. This is primarily due to the fact that, without the whipstock, the only force available to urge the mill sideways into the casing is the inherent stiffness of the milling tool and associated drill pipe transversing a curve in the casing (see FIGS. 1A–1B). In many cases, side loading on the milling tool is not sufficient to initiate and maintain cutting action.

In some cases a whipstock utilized in a downhole application for generating a window in casing is susceptible to damage from the aggressive cutting surface of a mill and, if not protected, is inadvertantly damaged or cut away.

There has long been a need for an efficient and effective milling system and method of its use. There has long been a need for a method for milling a window in a tubular at a desired location without the use of a whipstock. There has long been a need for a milling method which does not result in damage to a whipstock.

SUMMARY OF THE PRESENT INVENTION

The present invention, in one embodiment, discloses a method for milling a tubular of a string of tubulars in a wellbore, e.g. a piece of casing in a cased wellbore, the method including: installing a milling system in a tubular at a desired location at which a slot, opening, or window is to be milled out of the tubular; and milling the window through the tubular. In one aspect the milling system includes a mill (e.g., but not limited to, a starting mill or a section mill with two, three, four, five, six, seven or eight pivotable milling blades), and at least one weight member interconnected with or connected to the mill, e.g. a weight member below the mill or above the mill or both. In one embodiment centralizing apparatus is used above the mill, below the mill, or in both locations.

In one aspect the weight member is one or more joints (e.g. thirty feet long each) of drill pipe or drill collars. In another aspect the weight member(s) are solid tubulars made of metal, metal and plastic, or plastic-coated metal. In another aspect the weight member(s) are hollow so that additional weights and/or fluid is introducible therein either at the surface or when the system has been lowered to some desired location in a wellbore.

The centralizing apparatus may be any known centralizer, stabilizer, or reamer-stabilizer. In one aspect the centralizing apparatus has hollow blades or hollow centralizing members in fluid communication with a hollow bore through the centralizer so that additional weights and/or fluid is introducible into the centralizer either at the surface at some desired location in a wellbore.

In one aspect a measurement-while-drilling ("MWD") device is interconnected with or connected to the mill so that the well's location and orientation are known at the surface and can be adjusted as desired.

In one aspect a weight apparatus is employed that is flexible or that has a flexible or jointed part so that it will tend to lie against a bottom side of a downhole curved casing. In one particular embodiment an expansible tube or bladder is employed above or below (or both) the mill into which are introducible weights and/or fluid either at the surface or at a desired location downhole in a wellbore.

In one aspect in which a hollow weight member is used, a selective release apparatus is employed (e.g. but not limited to a burstable diaphragm, a rupture disc, or a bursting tube as described in U.S. application Ser. No. 08/429,763 filed Apr. 26, 1995 entitled "Cementing System" now U.S. Pat. No. 5,553,667 or the U.S. application Ser. No. 08/632,927 which is the offspring of U.S. application Ser. No. 08/429,763 filed on Apr. 16, 1996 entitled "Wellbore Cementing System," both co-owned with the present invention, both applications incorporated fully herein by reference for all purposes) so that either during milling or when milling is completed the weight apparatus is opened so that weights and/or fluid flow out therefrom and into the casing or wellbore.

In one aspect of the present invention, a selectively operable biasing member is positioned above the mill, below the mill, or in both locations. Such a biasing member may be any known device which is hydraulically, pneumatically, and/or mechanically selectively activated from the surface for moving a tubular to one side in another tubular or in a wellbore. Such biasing member(s) may be used with or instead of a whipstock. In one aspect the biasing member is a selectively fillable or inflatable bladder or packer which expands to one side of the mill thereby forcing the mill against one side of a tubular or casing. Such a biasing member is useful to direct a mill toward the bottom side of a curved or horizontal casing or toward the top side of a curved or horizontal casing, i.e., it can facilitate milling on a bottom side or on a top side, and is also useful to facilitate milling in one location (side, top, or bottom) and then, after deactivation and movement, is activated again for milling in another location (top, side, or bottom).

In certain embodiments the present invention discloses tapered members for use with or connection to blades of a mill to facilitate and ease insertion of the mill through a tubular string, e.g. past upsets and/or indentations of casing. In another aspect retractable leaf springs or spring bows are used below the mill blades to inhibit or prevent the bottom surfaces of the blades or the blade points from catching on items or surfaces in the casing.

In certain embodiments the weight member is cylindrical, hollow or solid, and extends downwardly from a mill and is either secured thereto, removably connected thereto, or formed integrally thereof.

It is, therefore, an object of at least certain preferred embodiments of the present invention to provide:

New, useful, unique, efficient, nonobvious wellbore milling methods, methods for directing a milling tool to mill a hole, slot, or window in a tubular in a wellbore and tools useful in such methods;

Such a method useful with or without a whipstock;

Such a method in which a milling tool is directed by one or more biasing members and/or one or more selectively activatable biasing devices against a tubular;

Such a method or apparatus in which one or more weight members direct a mill against a tubular; and Apparatus useful in such methods.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figures 1A, 1B, 2A, 2B:
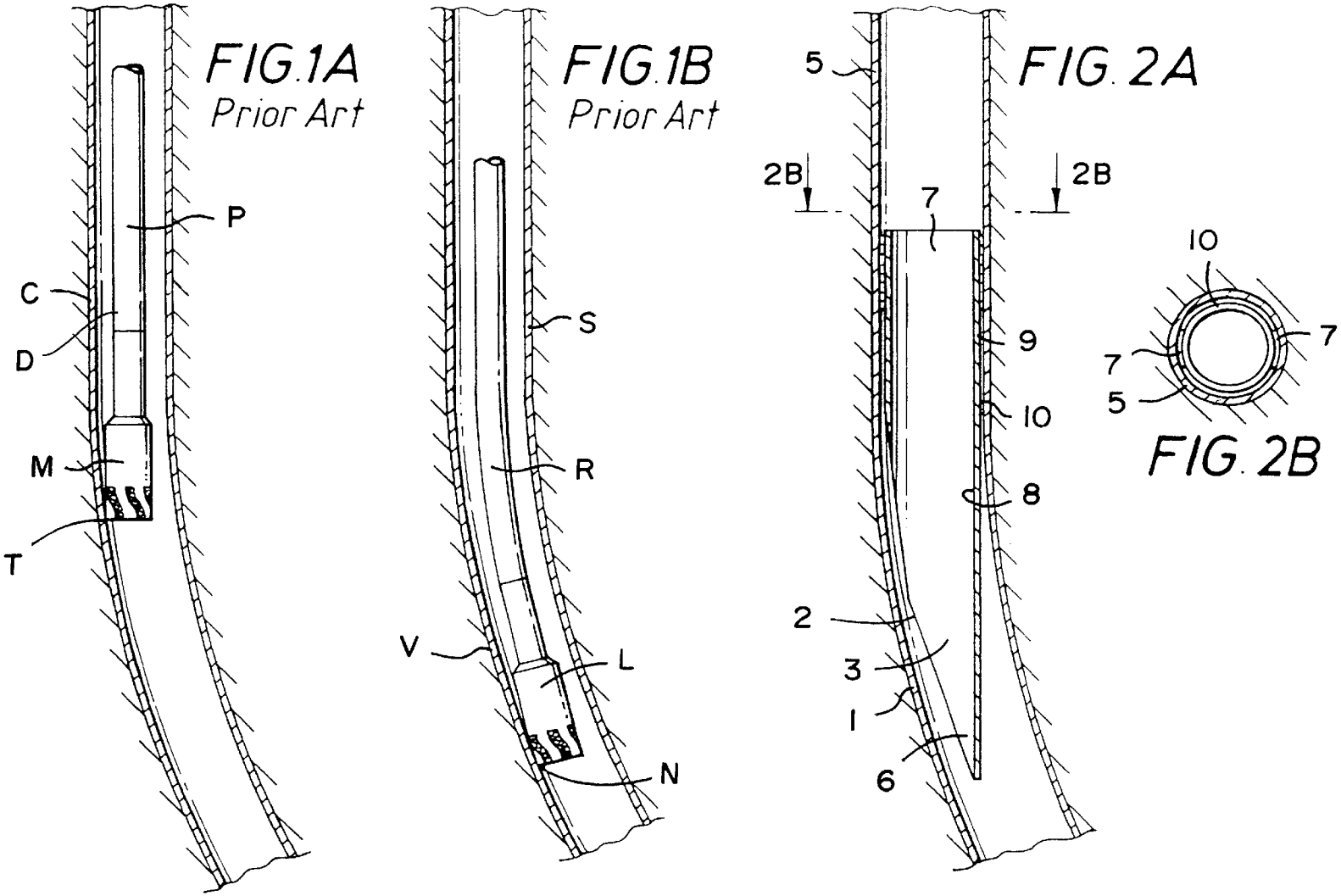
FIG. 1B Prior Art
FIG. 1A Prior Art
FIG. 1A is a schematic side view, partially in cross-section, of a prior art system with a mill inside a casing to be milled.
FIG. 1B is a schematic side view, partially in cross-section, of a prior art system with a mill inside a casing to be milled.
FIG. 2A is a side view in cross-section of a mill guide according to the present invention anchored in a wellbore casing.
FIG. 2B is a top end cross-sectional view of the mill guide and casing of FIG. 2A.

FIG. 1A shows a prior art mill M attached to drill pipe P in a casing C. When the mill M contacts the interior of the casing C at a point T, the mill M tends to be deflected away from the point T. The stiffness of the drill pipe P (and other drill pipe and items in a string above and connected to the drill pipe P, not shown) is, in most cases, insufficient to prevent the mill M from deflecting away from the interior of the casing C.

FIG. 1B shows a prior art mill L attached to a drill pipe R in a casing S with a curved portion V. When the mill L contacts the interior of the casing S at a point N of the curved portion V, the mill L is deflected away from the point N.

FIGS. 2A and 2B show a mill guide 10 according to the present invention with a hollow cylindrical body 9 having a bore 8 therethrough, an open top end 7 and an open bottom end 6. The mill guide 10 is disposed in a piece of casing 5 which is part of a string of casing (not shown) in a wellbore in the earth. An anchor 4 (or anchors) holds the mill guide 10 in place at a desired location in the casing with an opening 3 of the mill guide's bottom end 6 disposed and oriented so that a mill passing through the mill guide 10 will mill a desired area of the casing, creating a desired hole, slot, opening, or window. The bottom end 6 of the mill guide 10 is formed or cut to have a desired shape 2. This shape 2 may be made to correspond to a curved portion 1 of the casing 5.

Figure 3:
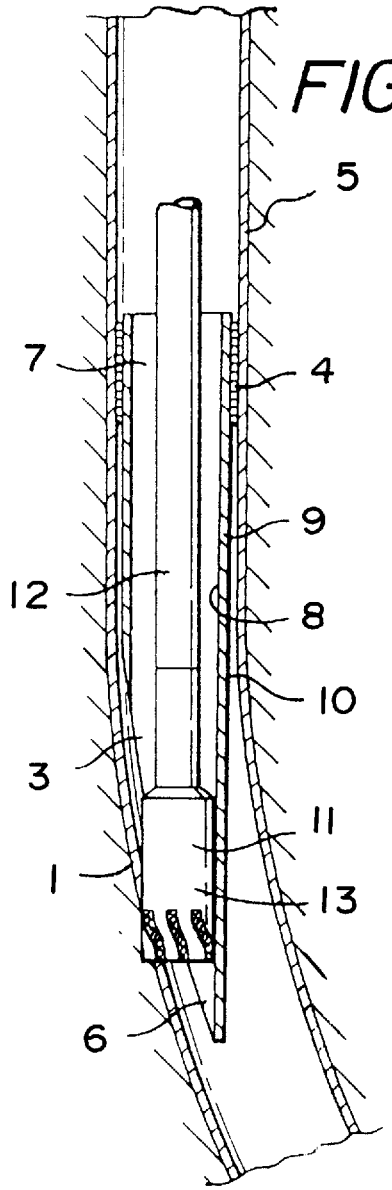
FIG. 3 is a side view of the system of FIG. 2A including a milling apparatus.

As shown in FIG. 3, a mill 11 on a string of drill pipe 12 has been introduced through the casing 5 and the mill guide 10 to contact the casing 5 and begin to mill a hole therethrough. A body 13 of the mill 11 has a length such that at least about a fourth of the desired opening is milled (and in other aspects substantially all of the desired opening) while the mill body 13 remains in contact with a side 30 of the bottom end 6 of the mill guide 10, thus providing a continuous reaction support during part or substantially all of the milling. The side 30 may be the same thickness as a side 32 which is shorter than the side 30; or the side 30 may be thicker than the side 32. The interior of the side 30 may one or more additional layers of material thereon. Such material may also inhibit the mill from milling the side 30. This additional material may be any desired practical thickness and may be any known suitable material, including, but not limited to, steel, carbide steel, stainless steel, known alloys, and hardfacing material. Such a layer or layers may be added by any known method (e.g., welding or hardfacing) or may be formed integrally of the side 30.

Figure 4:
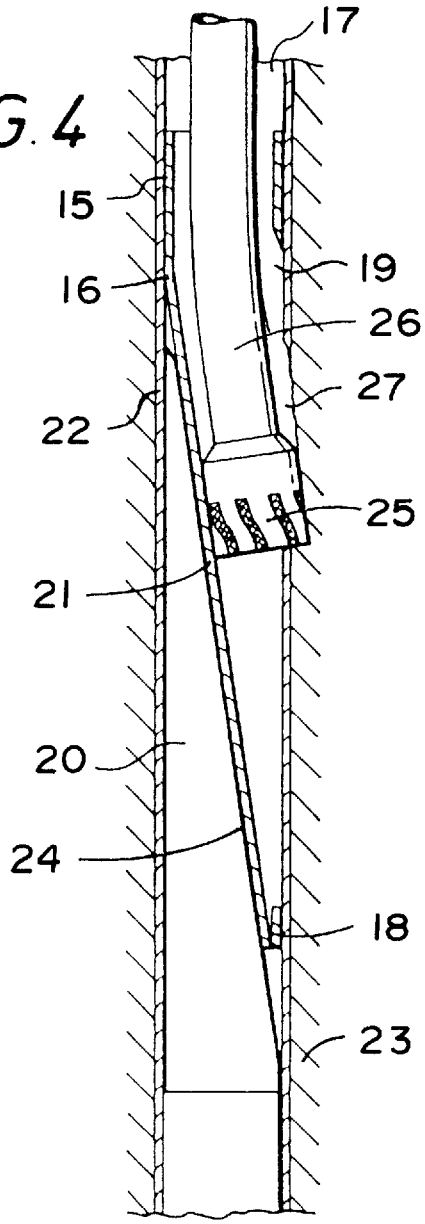
FIG. 4 is a side view, partially in cross-section of a system according to the present invention.

FIG. 4 shows a mill guide 15 with a hollow body 16, a top open end 17, a bottom end point 18, a side opening 19, and a slanted side member 21. A whipstock 20 disposed in a casing 22 in a wellbore 23 has a concave surface 24 which corresponds to the shape of the slanted side member 21. The mill guide 15 is made of a strong metal, e.g. steel, so that the slanted side member 21 protects the concave surface 24 from the effects of a mill 25 on flexible pipe 26. The whipstock 20 and the side opening 19 are positioned so that a window 27 is cut at a desired location on the casing 22. As shown in FIG. 4 the window 27 has only been partially milled and will be completed as the mill 25 moves down the slanted side member 21. It is within the scope of this invention for the mill guide 15 and the whipstock 20 to be connected together; to be formed integrally as one member; or for the mill guide 15 to be releasably connected to the whipstock (e.g. but not limited to, by one or more shear studs or shear lugs). In another aspect the mill guide and the whipstock are installed separately.

Referring now to FIGS. 5A–5D, a system 100 according to the present invention has an upper hollow connector or sub 102 interconnected with a tubular string 104 that extends up to the surface in a wellbore 106 cased with casing 108. A stabilizer 110 is connected to one (or more) pieces of drill pipe (or drill collars) 112. A mill 114 is connected to the drill pipe 112. A weight member 116 (optionally with centralizing blades, two or more, not shown) is connected to the mill 112.

Figures 5A, 5B, 5C, 5D:
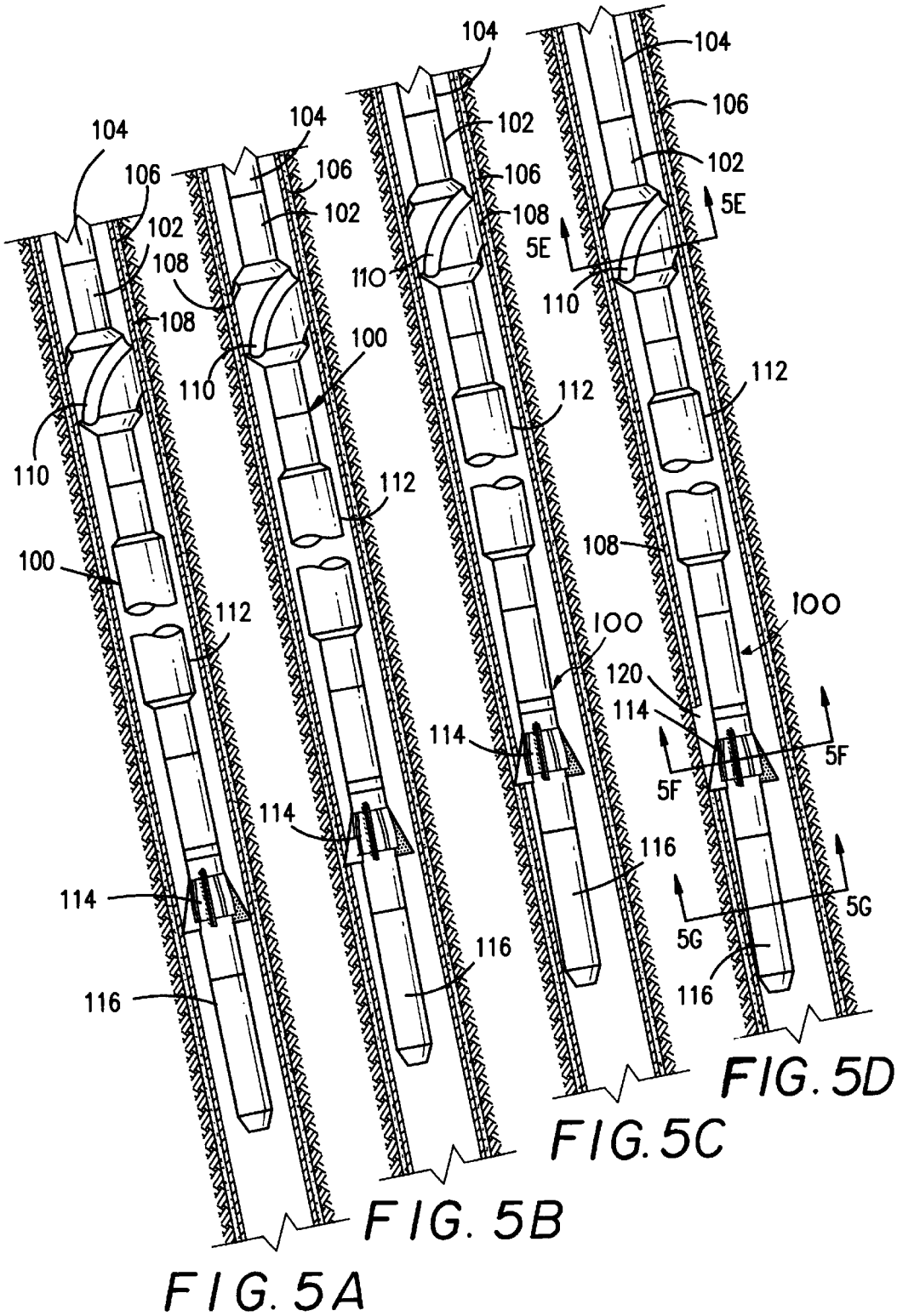
FIGS. 5A–5D are side views of a milling system according to the present invention.
Figure 5E:
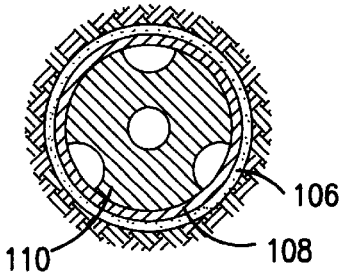
FIG. 5E is a cross-section view along line 5E—5E of FIG. 5D.

As shown in FIG. 5A the system 100 has been lowered in the casing 108 to a desired location. As shown in FIG. 5B the mill 114 has begun to mill the casing 108. As shown in FIG. 5C the mill 114 has milled through the casing 108 and the weight member 116 has moved off center due, inter alia, to the force of gravity thereby directing the mill 114 against the casing (to the left in FIG. 5C). As shown in FIG. 5D, the mill 114 has milled out an opening or window 120 in the casing 108.

Figure 5F:
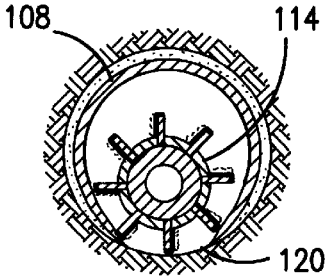
FIG. 5F is a cross-section view along line 5F—5F of FIG. 5D.
Figure 5G:
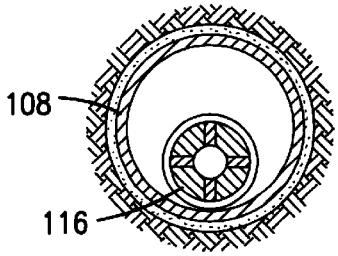
FIG. 5G is a cross-section view along line 5G—5G of FIG. 5D.

As shown in FIGS. 5A–5D the wellbore 106 is canted from the vertical. It is to be understood that the system 100 is useful in any wellbore in which gravity will act on the weight member 116 to facilitate the directing of the mill against the casing, including, but not limited to, a horizontal wellbore. FIG. 5F shows all the blades on the mill 114, but FIGS. 5A–5D show slots where some of the blades are located.

Figure 6:
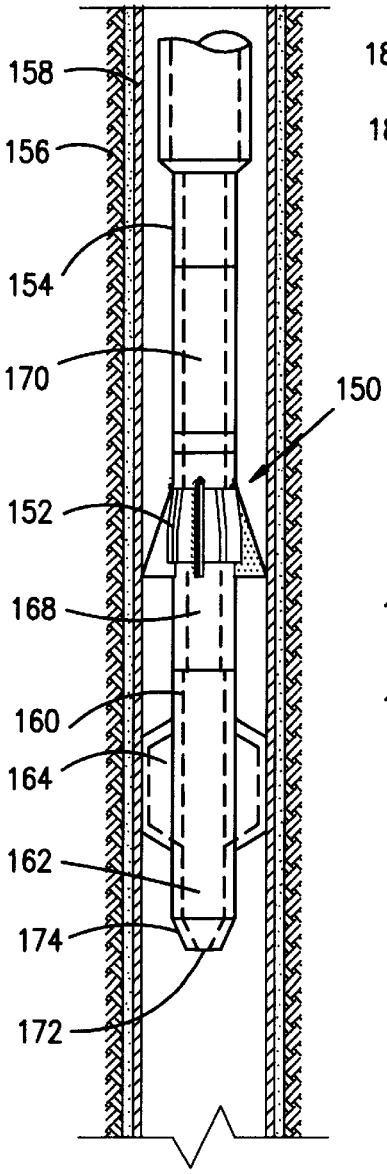
FIG. 6 is a side view of a system according to the present invention.

FIG. 6 shows a system 150 according to the present invention with a mill 152 connected to a tubular string 154 which extends to the surface (not shown) in a wellbore 156 cased with casing 158. A weight member 160 is connected to the mill 154. Fluid and/or weights are introducible into an interior 162 of the weight member 160 and into an interior 164 of blades 166 of the weight member 160 via a flow bore 168 through the mill 152 and a flow bore 170 of the tubular string 154. If there is a fluid in the casing, e.g. water or drilling fluid, the fluid used to add weight to the weight member is denser than the fluid already present. Additional weights may be used with or instead of fluid. In certain aspects these weights are rocks or spheres of metal, or plastic-coated or Teflon™—coated iron, steel, aluminum, aluminum alloy, zinc, zinc alloy, plastic or some combination thereof. These spheres may range in size from microspheres to spheres several inches (½ inch, 1, 2, 3, or more inches) in diameter.

A rupture disc or diaphragm 172 is positioned in a lower end 174 of the weight member 160. By increasing fluid pressure to a desired pressure level on the rupture disc 172, the disc bursts and the contents of the weight member (and string) flow out and into the casing.

Figure 7A:
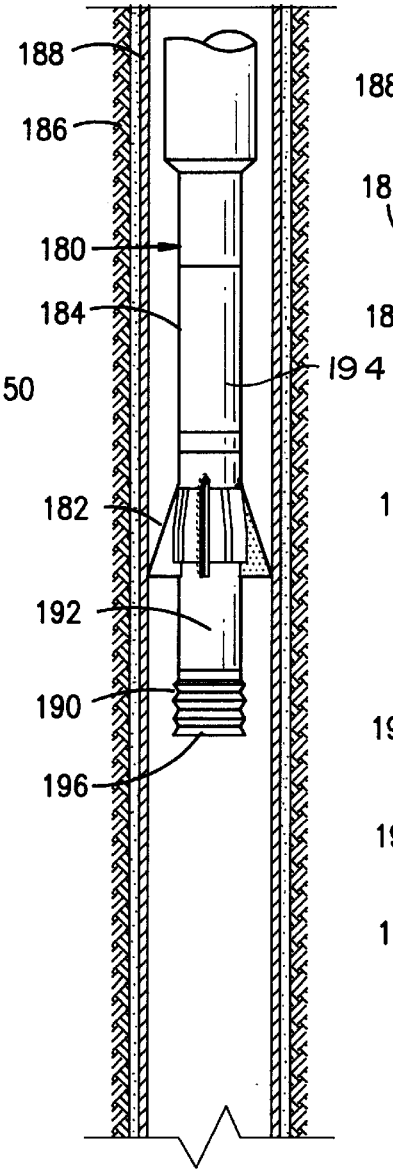
FIG. 7A is a side view of a system according to the present invention.
Figure 7B:
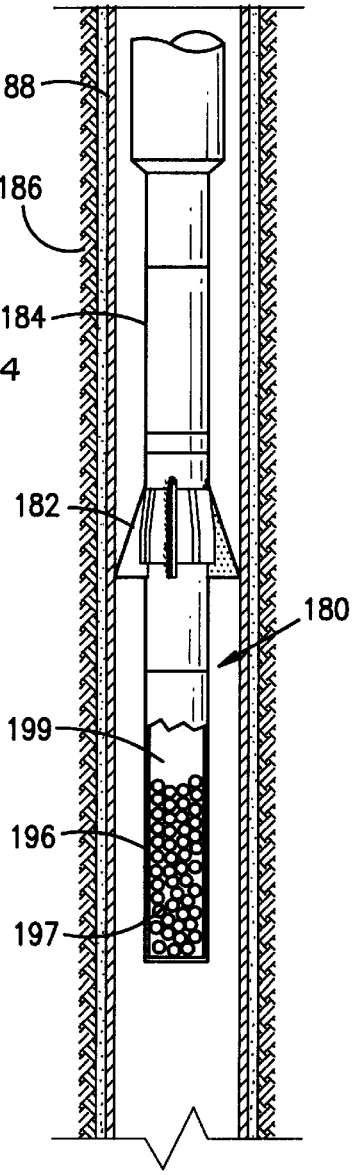
FIG. 7B is a side view of the system of FIG. 7A.

FIG. 7A shows a system 180 according to the present invention with a mill 182 connected to a tubular string 184 which extends to the surface (not shown) in a wellbore 186 cased with casing 188. A weight member 190 is connected to the mill 182 and via a flow bore 192 through the mill and a flow bore 194 through the tubular string, additional weights and/or fluid is introducible into an extendable hollow member 196 of the weight member 190. The extendable hollow member 196 is shown as made of a tough yet flexible material, e.g. Kevlar™ material, Aramid™ material, plasticized rubber, etc.; however, it could be made of plastic or metal telescoping pieces. As shown in FIG. 7B, the extendable hollow member 196 has extended due to the weight of spherical weights 197 and fluid 199. The fluid 199 could extend further up to the mill, to the tubular string, and to the surface as desired.

Figures 8, 9:
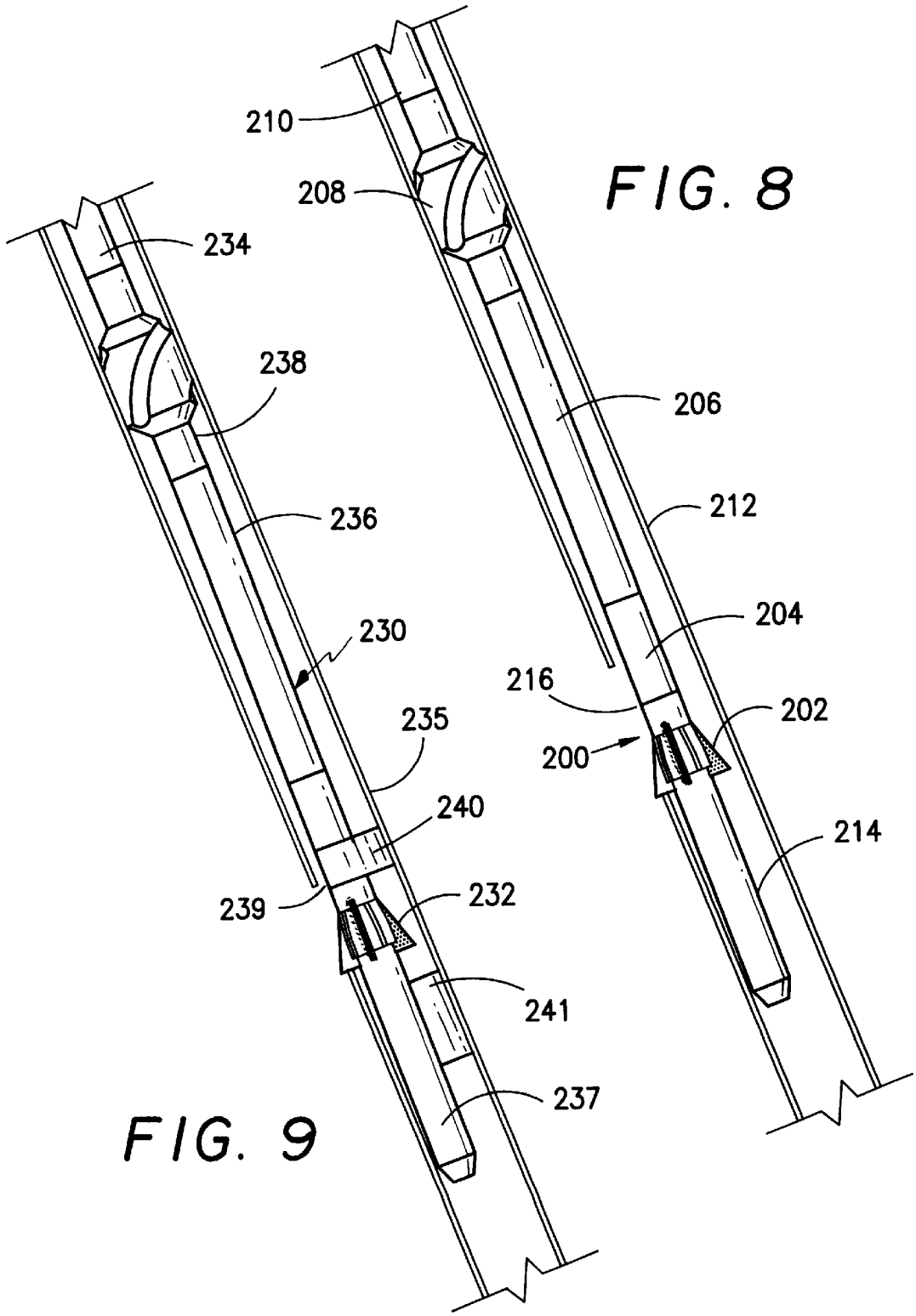
FIG. 8 is a side view partially in cross-section of a system according to the present invention.
FIG. 9 is a side view partially in cross-section of a system according to the present invention.

FIG. 8 shows a system 200 according to the present invention with a mill 202 connected to measurement-while-drilling apparatus 204 which is connected to a joint of drill pipe 206. A stabilizer 208 is connected to the drill pipe 206 and a tubular string 210 (shown partially) is connected to the stabilizer 208. The tubular string extends to the surface in a wellbore (not shown) cased with casing 212. A weight member 214 (like any weight member shown and/or described herein) is connected beneath the mill 202 and the drill pipe 206 acts as a weight member above the mill 202. As shown a window 216 has been milled by the mill 202 in the casing 208 and the weight members have directed the mill against the bottom side of the casing.

FIG. 9 shows a system 230 according to the present invention with a mill 232 connected to a joint of drill pipe 236. A stabilizer 238 is connected to the drill pipe 236 and a tubular string 234 (shown partially) is connected to the stabilizer 238. The tubular string extends to the surface in a wellbore (not shown) cased with casing 235. A weight member 237 (like any weight member shown and/or described herein) is connected beneath the mill 232 and the drill pipe 236 acts as a weight member above the mill 232. As shown a window 239 has been milled by the mill 232 in the casing 235 and the weight members have directed the mill against the bottom side of the casing.

A selectively operable (from the surface or by introducing an object into the tubular string to go down to it) biasing apparatus 240 is disposed above the mill 232 which is activated when the mill 232 is in the desired location for forming the window 236. Another selectively operable biasing apparatus 241 is disposed on the weight member 237 and, as shown in FIG. 9, has been activated to bias the system 230 against one side of the casing. Alternatively, the biasing apparatus or apparatuses can be oriented so that the system 230 is pushed upwardly so that milling on the top side of the casing is facilitated. Systems according to this invention may use only one of the biasing apparatuses describe herein.

Figure 10:
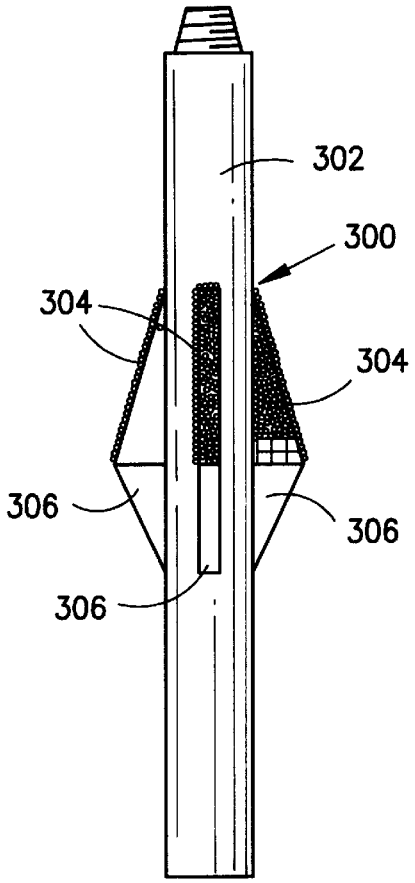
FIG. 10 is a side view of a mill according to the present invention.

FIG. 10 shows a mill 300 according to the present invention with a body 302 and a plurality of blades 304. Associated with each blade 304 is a taper member 306 which is secured to the body 302, or to the blade 304, or to both, either with an adhesive such as epoxy, with connectors such as screws, bolts, or Velcro ™ straps or pieces, or by a mating fit of parts such as tongue-and-groove. The taper members may be made of any suitable wood, plastic, composite, foam, metal, ceramic or cermet. In certain embodiments the taper members are affixed to the mill so that upon contact of the lower point of the mill blades with the casing to be milled, the taper members break away so that milling is not impeded.

Figure 11:
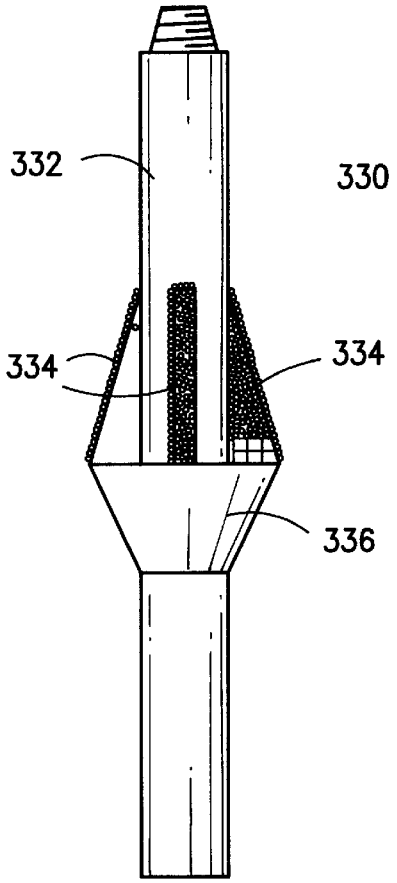
FIG. 11 is a side view of a mill according to the present invention.

FIG. 11 shows a mill 330 according to the present invention with a body 332 and a plurality of blades 334. A taper device 336 is secured around the mill 330 or formed integrally thereon. The taper device 336 extends around the entire circumference of the mill 330 beneath the blades 334 and facilitates movement of the mill 330 through tubulars. The taper device 336 may be a two-piece snap-on or bolt-on device and may be made of the same material as the taper member 306.

Figure 12:
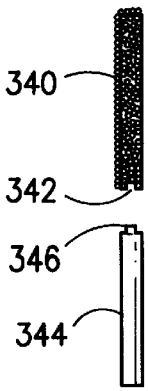
FIG. 12 is a side view of a blade with a taper member according to the present invention.

FIG. 12 shows a blade-taper member combination with a blade 340 having a groove 342 and a taper member 344 with a tongue 346. The tongue 346 is received in the groove 342 to facilitate securement of the taper member 344 to the blade 340. Optionally, an epoxy or other adhesive may be used to glue the taper member to the blade, to a mill body, or to both. The tongue and groove may be dovetail shaped.

Figure 13:
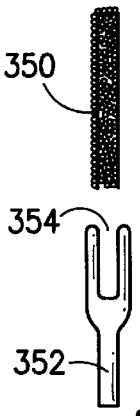
FIG. 13 is a side view of a blade with a taper member according to the present invention.

FIG. 13 shows a blade-taper member combination with a blade 350 and a taper member 352 with a recess 354. The blade 350 is received in and held in the recess 354. Optionally an adhesive may be used to enhance securement of the taper member 352 to the blade, to the mill, or to both.

Figure 14:
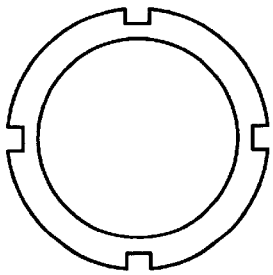
FIG. 14 is a bottom view of a mill body according to the present invention.

FIG. 14 shows a mill body 370 like the bodies of the mills shown in FIG. 5A, 10, and 11, but with a series of grooves 372 therein which extend longitudinally on the mill body and are sized, configured, and disposed to receive and hold a taper member as shown in FIG. 10, FIG. 12, or FIG. 13. Such a mill body may be used instead of or in combination with any previously-described taper securement means.

Figure 15:
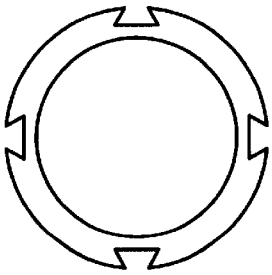
FIG. 15 is a bottom view of a mill body according to the present invention.

FIG. 15 shows a mill body 380 like the bodies of the mills shown in FIGS. 5A, 10, and 11, but with a series of dovetail grooves 382 therein which extend longitudinally on the mill body and are sized, configured, and disposed to receive and hold a taper member as shown in FIG. 10, FIG. 12, or FIG. 13. Such a mill body may be used instead of or in combination with any previously-described taper securement means.

Figure 16:
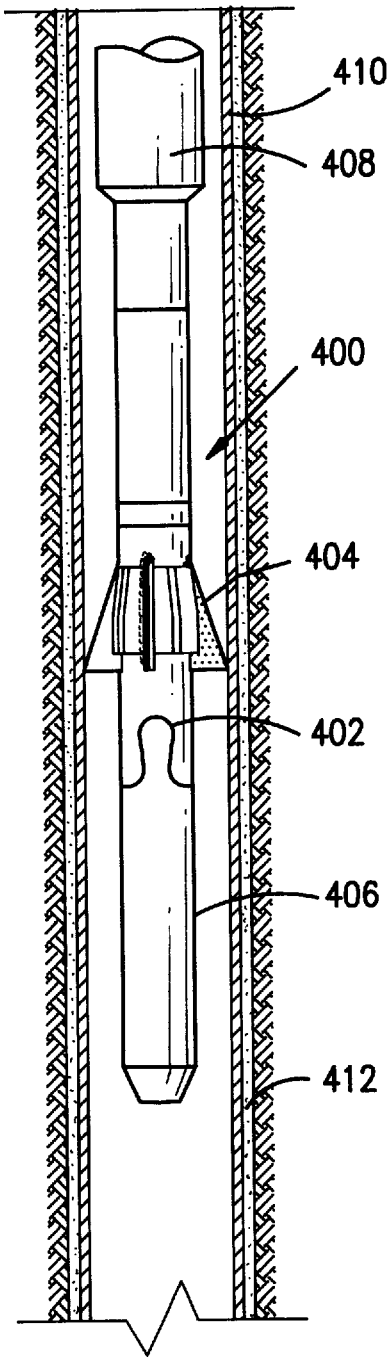
FIG. 16 is a side view of a system according to the present invention.

FIG. 16 shows a system 400 like previously described systems, but with a flexible connection 402 between a mill 404 and a weight member 406. The flexible connection permits pivoting of the weight member 406 with respect to the mill 404 in response to the force of gravity. The mill 404 is connected to a tubular string 408 which extends up to the surface (not shown) in a casing string 410 in a wellbore 412. Flexible connections are well known, see e.g. U.S. Pat. No. 4,699,224. Alternatively a ball-and-socket joint may be used or a knuckle-joint, see also U.S. Pat. No. 4,699,224.

Figure 17:
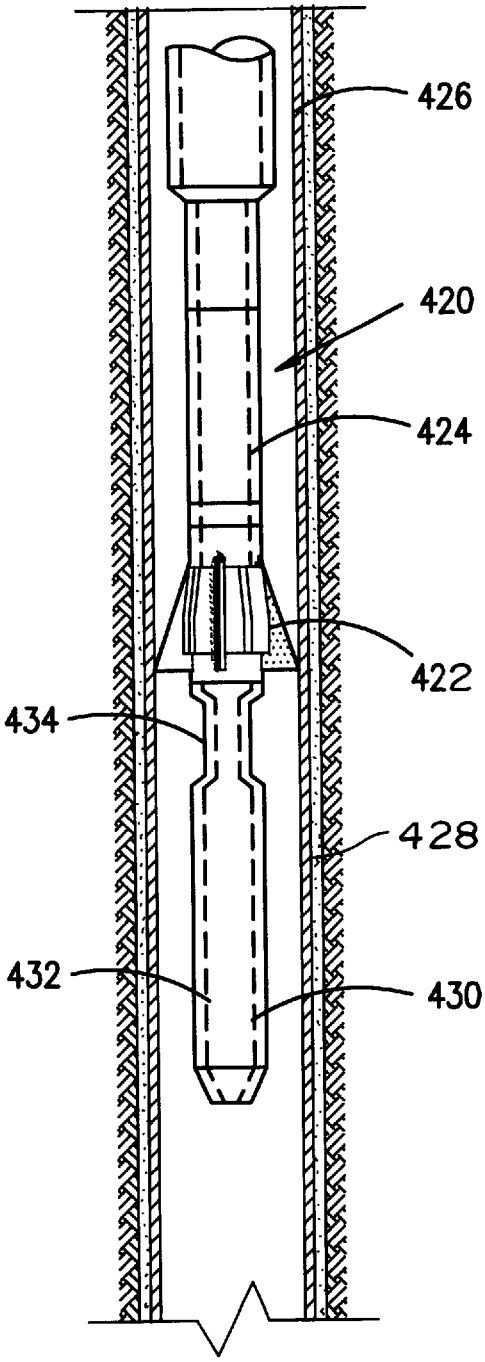
FIG. 17 is a side view of a system according to the present invention.

FIG. 17 shows a system 420 with a mill 422 connected to a tubular string 424 which extends to the surface (not shown) through a casing string 426 in a wellbore 428. A weight member 430 connected to the mill 422 has a body 432 with a flexible neck 434 which permits the weight member to move toward a bottom side of the casing in response to the force of gravity. Additional weights or fluid may be added to the weight member 430 as described for previous embodiments.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A method for milling a window through a tubular member of a tubular string which extends through a wellbore in the earth, the wellbore extending down from the earth's surface, the method comprising introducing a wellbore milling system into the tubular member to a location at which a window is to be milled, the wellbore milling system comprising a mill to mill the tubular member, the mill having a top and a bottom, and a weight member secured to the mill for directing the mill against an inner side of the tubular member at the location at which the window is to milled through the tubular member, directing the mill against the inner side of the tubular member with the weight member, and milling the window through the tubular member with the mill.

2. A wellbore milling system for milling a window through a tubular member of a tubular string in a wellbore that extends non-vertically down from a surface of the earth into the earth, the wellbore milling system positionable within the tubular member and comprising a mill to mill the tubular member, the mill having a top and a bottom, and a weight member secured to the mill for directing the mill against an inner side of the tubular member at a location at which a window is to milled through the tubular member, the mill having a flow channel therethrough from top to bottom, and the weight member having a flow channel therethrough from a top to a bottom thereof which is in communication with the flow channel of the mill, and a rupturable member for initially blocking flow through the weight member, the rupturable member disposed across the flow channel of the weight member, the rupturable member rupturable in response to fluid under pressure on the rupturable member.

3. The wellbore milling system of claim 2 further comprising stabilizing apparatus interconnected with the mill.

4. The wellbore milling system of claim 3 further comprising the stabilizing apparatus comprising a stabilizer connected to at least one pipe which is connected to the mill.

5. The wellbore milling system of claim 4 wherein the stabilizer is connected above the mill.

6. The wellbore milling system of claim 2 further comprising the weight member secured to the bottom of the mill.

7. The wellbore milling system of claim 2 further comprising the weight member secured in a tubular string above the mill.

8. The wellbore milling system of claim 2 further comprising weighting material introduced through the mill into the weight member.

9. The wellbore milling system of claim 2 wherein the weight member is an extendable member.

10. The wellbore milling system of claim 2 further comprising measurement-while-drilling apparatus interconnected with the mill.

11. The wellbore milling system of claim 2 further comprising selectively operable biasing apparatus connected to the mill for pushing the mill toward a portion of the tubular member to be milled.

12. The wellbore milling system of claim 11 wherein the selectively operable biasing apparatus is a first apparatus connected below the mill and the wellbore milling system further comprising a second selectively operable biasing apparatus connected above the mill.

13. The wellbore milling system of claim 2 wherein the mill has a body and a plurality of milling blades secured to the body and the wellbore milling system further comprising a taper device connected to the blades, the taper device tapering inwardly toward the mill body from an outer periphery of the blades to facilitate movement of the mill through the tubular string to the location at which a window is to be milled.

14. The wellbore milling system of claim 13 wherein the taper device extends around the mill body beneath the blades.

15. The wellbore milling system of claim 13 wherein the taper device comprises an individual tapered member associated with and secured to the mill body below each blade.

16. The wellbore milling system of claim 2 further comprising:

a flexible member connecting the weight member to the mill.

* * * * *